US007621427B2

(12) United States Patent
Monti

(10) Patent No.: US 7,621,427 B2
(45) Date of Patent: Nov. 24, 2009

(54) DEVICE FOR DELIVERING PASTE SUBSTANCES INTO CONTAINERS

(75) Inventor: Giuseppe Monti, Pianoro (IT)

(73) Assignee: Marchesini Group S.p.A., Planoro (Bologna) (IT)

( * ) Notice: Subject to any disclaimer, the term of this patent is extended or adjusted under 35 U.S.C. 154(b) by 449 days.

(21) Appl. No.: 11/566,765

(22) Filed: Dec. 5, 2006

(65) Prior Publication Data

US 2007/0125808 A1 Jun. 7, 2007

(30) Foreign Application Priority Data

Dec. 7, 2005 (IT) ..... BO2005A0751

(51) Int. Cl.
*B67D 5/40* (2006.01)

(52) U.S. Cl. ..... 222/380; 222/361; 222/363; 222/367; 222/425; 222/453

(58) Field of Classification Search ..... 222/380, 222/363, 354–355, 360–361, 367–368, 425, 222/452, 453

See application file for complete search history.

(56) References Cited

U.S. PATENT DOCUMENTS 2,778,528 A * 1/1957 Corcoran ..... 222/46
2,934,872 A * 5/1960 Wise ..... 53/296
3,090,524 A * 5/1963 Corcoran ..... 222/46
3,311,272 A * 3/1967 Westbrook ..... 222/355
6,733,256 B1 * 5/2004 Knobel ..... 417/521
2004/0251279 A1 12/2004 Heitlinger

FOREIGN PATENT DOCUMENTS

DE 43 12 015 A1 10/1994
EP 1 739 018 A1 1/2007
GB 2 156 911 A 10/1985

* cited by examiner

*Primary Examiner*—Frederick C. Nicolas
(74) *Attorney, Agent, or Firm*—William J. Sapone; Coreman Sudol Sapone P.C.

(57) ABSTRACT

A device in an automatic machine feeds metered quantities of a paste substance to be introduced into containers by a filling nozzle. In the device, a central body has a bore defining a cylinder closed at top by a cap, and a parallel inlet channel leading to the bore through an inlet aperture. An inlet conduit block is fastened to the central body and connects the inlet channel with a hopper. An exhaust conduit is fastened to the central body and connects an outlet aperture, made in the cylinder, with a conveying device associated to a filling nozzle. A piston having a longitudinal groove is slidingly inserted in the cylinder. A power apparatus moves and rotates the piston along the cylinder, so as to bring the groove to face respectively the inlet opening, during a suction step with a downward motion of the piston, and the outlet aperture, during a delivery step with an upward movement of the piston. Quick couplings, operated without tools, removably fasten the central body to the inlet conduit block, the inlet conduit block to the hopper, the exhaust conduit to the conveying device and the stem to the power apparatus.

12 Claims, 4 Drawing Sheets

DEVICE FOR DELIVERING PASTE SUBSTANCES INTO CONTAINERS

FIELD OF THE INVENTION

The invention relates to automatic machines for packaging paste substances into containers such as tubes, jars and similar.

DESCRIPTION OF THE PRIOR ART

Known automatic machines for packaging paste substances into containers such as tubes, jars and similar, include devices for metering paste substances to be delivered.

The above mentioned paste substances can be of various types, e.g. food, cosmetic or pharmaceutical, and thus their viscosity may differ considerably.

In each case it is necessary to ensure a perfect metering of the substance filled into each container, so as to match the minimum quantity of product as stated on the label.

Many of the mentioned automatic machines use volumetric metering groups, which include a set of syringes feeding corresponding filling nozzles.

Each syringe has, on its outer part, an exchanger valve operated in step relation with the movement of the syringe piston, so as to first suck up the substance, coming out from a relevant container, into the syringe cylinder, through an inlet channel, and then, after that the latter has been closed, to convey a prefixed quantity of substance to the nozzle through a delivery channel.

The just described means are satisfactory as far as working reliability is concerned, although the step operation of the piston to go up and down in the syringe, as well as the commutation of the exchanging valve, require inevitable mechanical complexity, taking into account that the sets include a considerable number of syringes and relevant valves.

The same means ensure a good metering precision, but their structure causes significant downtimes each time various elements must be disassembled for cleaning, sanitation or sterilization operations.

The above operations must be performed when the substance is changed, and also at programmed intervals, if the same substance remains, so as to avoid the accumulation of residues which could deteriorate and damage another, fresh substance, getting in touch with the old one.

Obviously, the importance of what has been just said depends on the type of substance being processed, presumably higher in case of pharmaceutical and food substances.

Therefore, it would be useful to avoid the above mentioned disadvantages without jeopardizing the measuring precision and the reliability of the means used so far.

Known valve-syringe devices incorporate the functions of exchanging valve and measuring syringe in one element.

The piston of such valve-syringe has a longitudinal groove which extends downwards from the piston top along a part of the piston skirt.

The piston is operated to move in the cylinder in the traditional up-and-down direction, as well as to rotate with respect to the cylinder, so as to bring the longitudinal groove alternately to match with an inlet aperture and with an outlet aperture, thus setting the inside of the cylinder in communication with first while keeping shut the latter, and vice-versa.

The above mentioned valve-syringe is used in automatic machines for filling containers with liquid products and its advantageous structure is much appreciated, because its dimensions are more compact with respect to a syringe with an external valve, and because it allows to apply a simpler control mechanism, since the piston two movements are effected through the same stem, and finally, because its disassembling from and assembling to the machine for washing and/or sterilization operations is much more rapid with respect to the known solution with external valve.

However, the above mentioned valve-syringes cannot be used, as they are conceived currently, with paste substances, because the shape, the dimensions and the structure of the relative inlet channel, usually made of a flexible pipe, do not ensure a regular flow of the substance in the cylinder.

Actually, during the suction, cavities can be formed in the substance, if it does not manage to flow in the channel, and consequently measuring errors can occur.

Also the shape and the dimensions of the longitudinal groove can create problems, mainly when the viscosity is high, because there could remain areas not filled with the substance, which results in an insufficient dose.

Moreover, another disadvantage is the difficulty to clean the inlet channel, as well as the outlet channel and the time required for removing and attaching the valves from and to the valve-syringe body.

SUMMARY OF THE INVENTION

The object of the present invention is to propose a device for distribution of paste substance to relevant filling nozzles, which uses the operation principles of the known valve-syringes for liquids, but its structure is suitable for being used with paste substances of different nature and viscosity.

Another object of the present invention is to propose a device, whose shape allows to speed up the assembling and disassembling of the same to and from the machine, assembling and disassembling of various elements of the device, as well as interruption and restoring of the connections upstream and downstream of the latter.

A further object of the present invention is to propose a device, which is compact with respect to the known valve-syringe devices used for liquids.

A still further object of the present invention is to make the cleaning, sanitation and/or sterilization operations of the device elements rapid and efficient.

The above mentioned objects are obtained, in accordance with the contents of the claims, by a device for delivering metered quantities of a paste substances to containers, the delivering device being associated to an automatic machine including:

a hopper for supplying said paste substance to the delivering device;

at least one filling nozzle, connected to the delivering device;

the said delivering device including: a central body;

a vertical cylinder made in said central body, with an upper end open and two lateral diametrically opposite and horizontally aligned apertures, respectively an inlet aperture and an outlet aperture;

a cap for closing the upper end of said cylinder;

an inlet channel situated beside the cylinder and parallel to the cylinder, the inlet channel having an open upper end and a lower end leading to the inlet aperture of said cylinder;

a piston sliding to move up and down inside said cylinder between an upper dead position and a lower dead position;

a longitudinal groove extending from top of the piston downwards, along a part of the piston, such that a bottom end of said groove is aligned with lower ends of said inlet aperture and outlet aperture, when the piston is in the upper dead position;

an inlet conduit block fastened removably to said central body to connect a lower outlet aperture of said hopper with said inlet channel;

an exhaust conduit connecting said outlet aperture with conveying means leading to said filling nozzle;

a stem made integral with said piston and removably connected to power means provided for operating the piston to move up and down and into rotation in step relation with the up and down motion, so that when the piston goes down, said longitudinal groove faces said inlet aperture, for performing a suction step and introducing said paste substance, coming from the hopper, into said cylinder, whereas when the piston is moved upwards said longitudinal groove faces said outlet aperture, for performing a delivery step and delivering a metered quantity of paste substance expelled from the cylinder to said filling nozzle.

BRIEF DESCRIPTION OF THE DRAWINGS

The characteristic features of the invention will become more clear from the following description of a preferred embodiment of the proposed device, in accordance with the contents of the claims and with help of the enclosed figures, in which:

DESCRIPTION OF THE PREFERRED EMBODIMENTS

Figure 1:
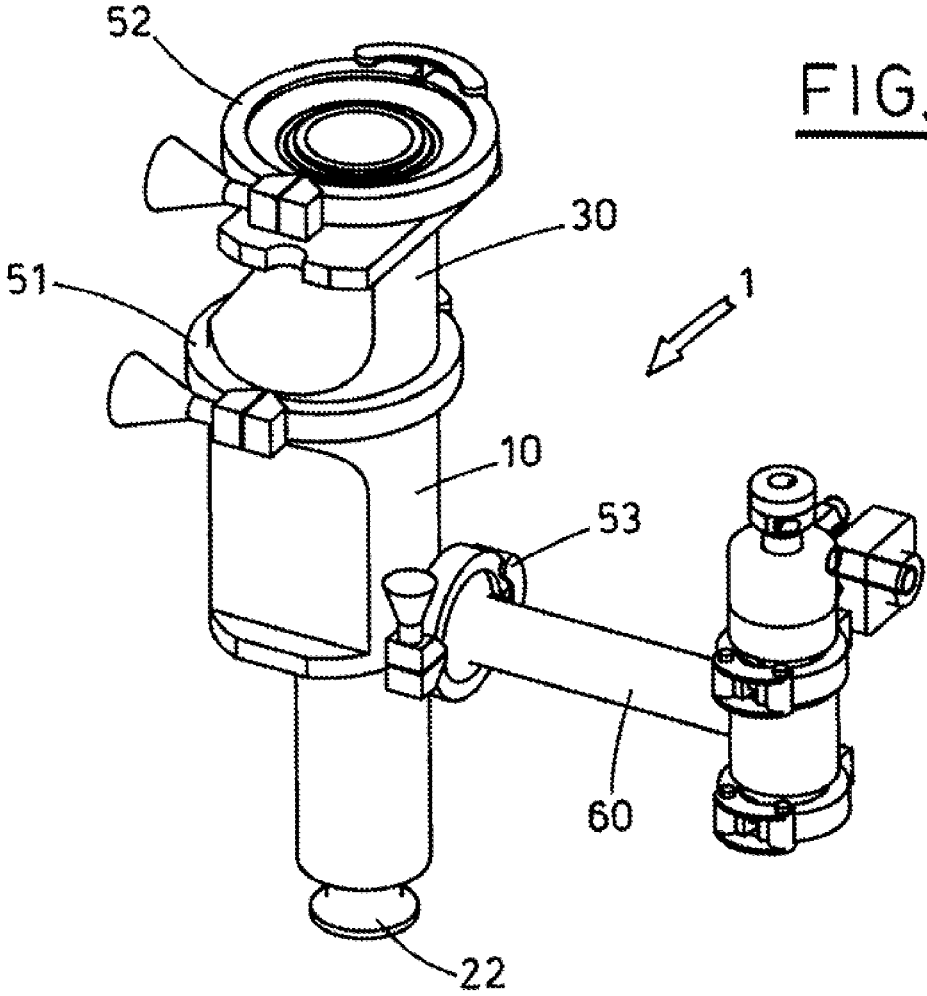
FIG. 1 is a perspective view of the proposed device.
Figure 3:
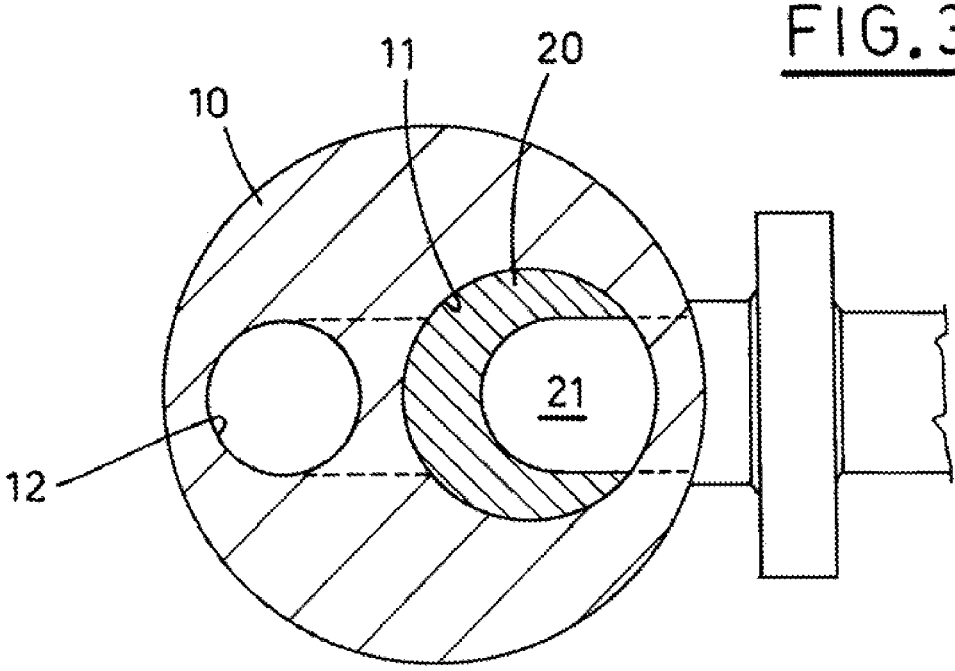
FIG. 3 is an enlarged, section view taken along the line III-III of FIG. 2.

Having regard to the above mentioned Figures, the reference numeral 1 indicates the proposed device as a whole.

The device 1 is to be mounted, alone or in a set, in an automatic machine (not shown) for packaging paste substances into relevant containers such as tubes, jars and the like.

As it has already been said in the introductory note, the above mentioned paste substances can be of different kinds, e.g. food, cosmetic or pharmaceutical, and can have different viscosity.

The paste substances are stored in a hopper 2 (shown only partially), whose lower part has an outlet aperture 2A, from which the substances flow out to the device 1, situated below.

The device 1 includes a central body 10, in which the bore of a cylinder 11, having vertical axis, is made, and an inlet channel 12, situated beside and parallel to the cylinder 11.

The upper part of the inlet channel 12 is open at the upper surface 10A of the central body 10, where also the upper end 11A of the cylinder 11 is open. The upper end 11A of the cylinder 11 is closed by a cap 110. The inlet channel 12 extends downwards up to about half the cylinder 11, then deviates at 90°, so as to open inside the cylinder 11, through an inlet aperture 13 made in the latter. An outlet aperture 14, opening laterally with respect to the central body 10, is made in the cylinder 11, diametrically opposite to the inlet aperture 13 and aligned horizontally therewith.

The section of the outlet aperture 14 and the section of the inlet aperture 13 are preferably identical.

A piston 20, sliding in the cylinder 11, extends axially with a dimension longer than the distance between the lower surface 110A of the cap 110 and the lower ends of said inlet aperture 13 and outlet aperture 14.

Figure 2:
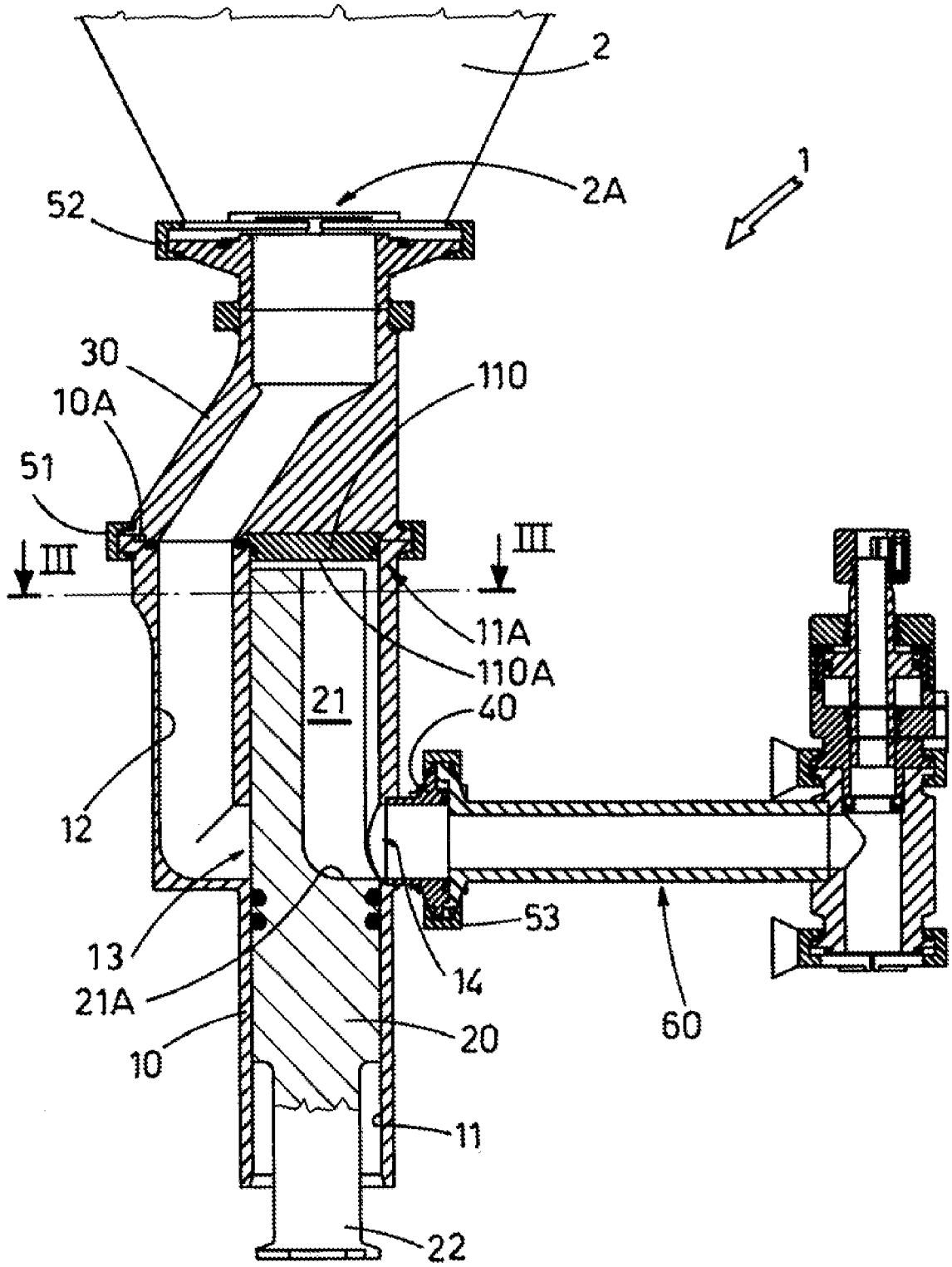
FIG. 2 is a vertical sectional view of the device of FIG. 1.

The piston 20 has a longitudinal groove 21, which extends downwards from the top of the piston 20, along a part of the piston skirt, so that the lower base 21A of said groove 21 is aligned with the lower end of said inlet aperture 13 and outlet aperture 14, when the piston 20 in its upper dead position (FIG. 2).

The longitudinal groove 21, seen from the top, has a rounded profile and a section at least equal to the section of the inlet channel 12. The upper surface 10A is suitably flattened to allow an inlet conduit block 30 to be removably fastened to the central body 10.

The inlet conduit of the inlet conduit block 30 is aimed at connecting the lower outlet aperture 2A of the hopper 2 with the inlet channel 12.

Fastenings of the central body 10 to the inlet conduit block 30, and of the latter to the hopper 2, are obtained by quick coupling means 51, 52, respectively first and second.

According to the shown example, the inlet conduit block 30 is shaped in such a way that the outlet aperture 2A of the hopper 2 is practically coaxial with the cylinder 11 and thus, the channel defined by the inlet conduit of the inlet conduit block 30 follows an inclined path.

However, the direction changes of the inclined path are made with very wide angles, to avoid the hindrance of the paste substance downward movement.

Likewise, the angle created at the joint between the inlet conduit of the inlet conduit block 30 and the inlet channel 12 is very wide.

After having been fastened to the central body 10, the upper part of the inlet conduit block 30 goes in abutment against the cap 110, thus preventing the latter from coming out. Therefore, a removable cap 110 can be provided, which allows more efficient cleaning operations, as it will be specified later.

According to an embodiment, not shown, an inlet conduit block 30 has the vertical and straight conduit, with the axis of the outlet aperture 2A centered with respect to the axis of the inlet channel 12.

An exhaust conduit 40, fastened beside the central body 10, aimed at connecting the outlet aperture 14 with conveying means 60, connected to a filling nozzle, not shown, aimed at introducing a metered quantity of paste substance in the containers, likewise not shown.

The exhaust conduit 40 and the conveying means 60 are fastened to each other by third coupling means 53.

Figure 4:
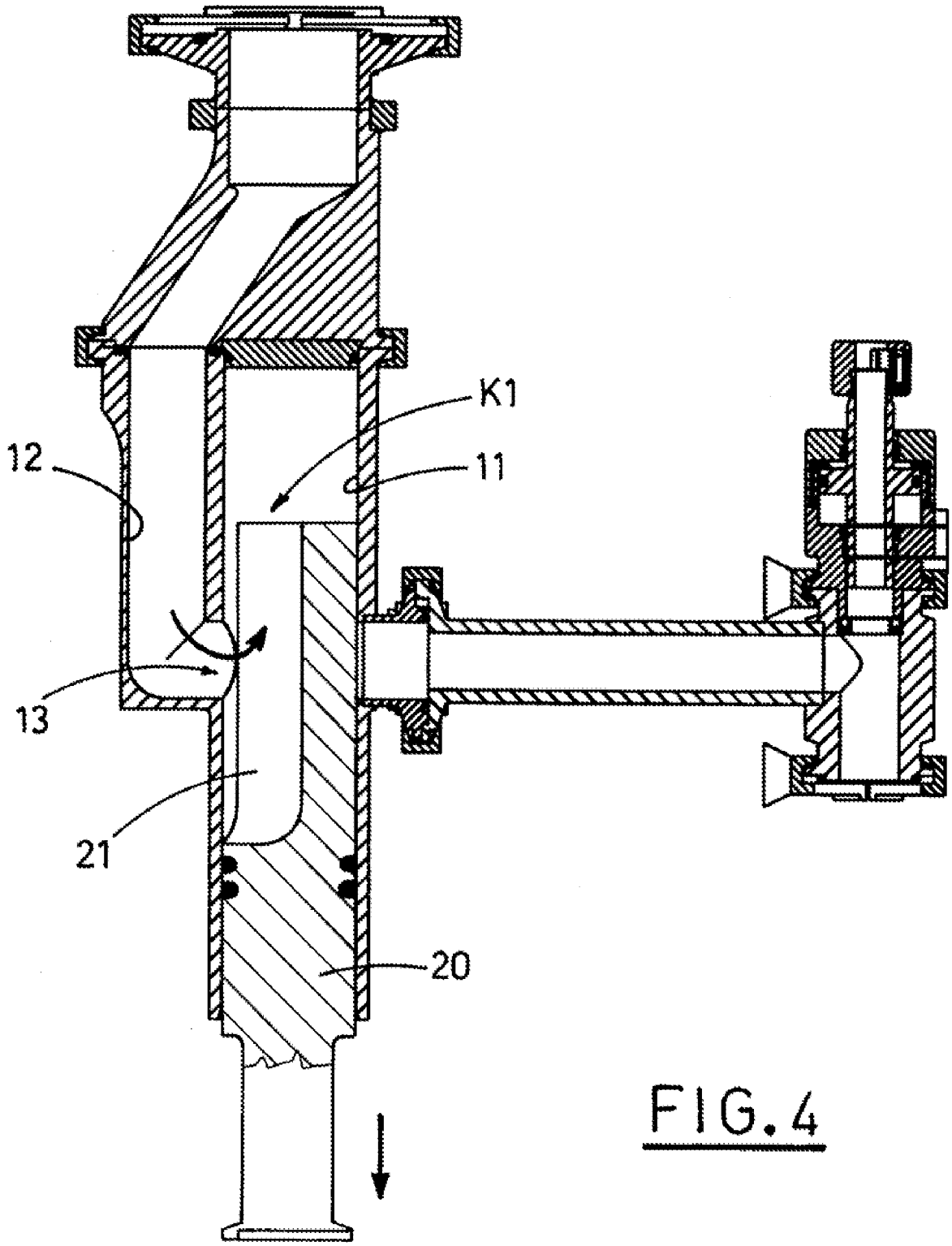
FIGS. 4, 5 are the same views as FIG. 2 of the device respectively in the suction step and in the substance delivery step.
Figure 5:
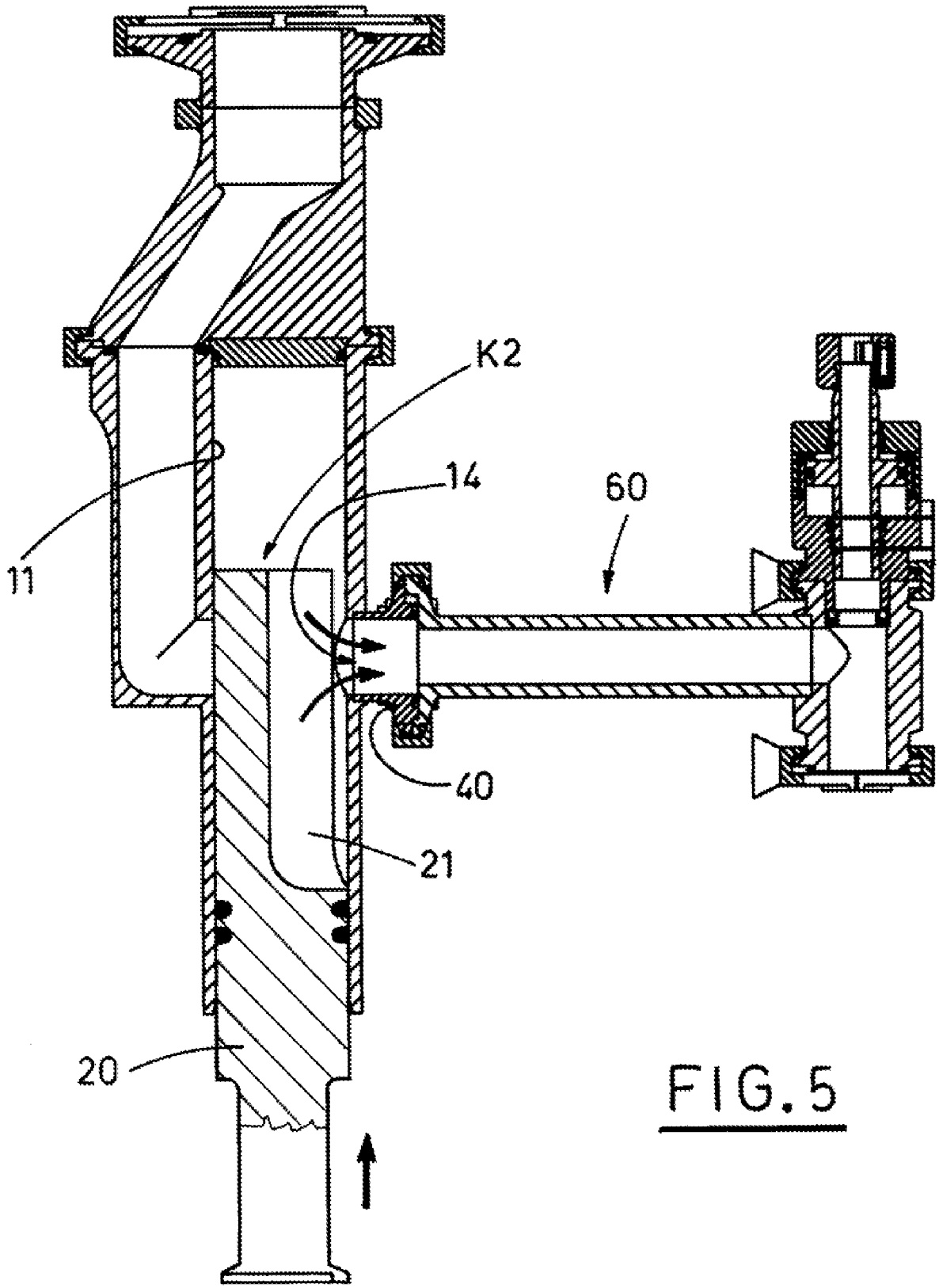

A stem 22, made coaxial and integral with the lower part of the piston 20, is aimed at being connected removably to power means of the machine, not shown, which operate the piston 20 to move up and down in the cylinder 11 and to rotate with respect thereto, between two extreme positions K1 and K2, in which the longitudinal groove 21 faces respectively the inlet aperture 13 (FIG. 4) and the outlet aperture 14 (FIG. 5).

The stem 22 is connected to the power means by fourth quick coupling means, not shown, since similar to the other, discussed previously. In said position K1 the inside of the cylinder 11 communicates with the inlet channel 12 and the outlet aperture 14 is closed; conversely, in the position K2, the inside of the cylinder 11 communicates with the exhaust conduit 40, while the inlet aperture 13 is closed.

Now an operation cycle of the device 1 will be described, beginning from a suction step (FIG. 4), in which the piston 20 is first rotated to bring the longitudinal groove 21 to the position K1, then made go down to its lower dead position.

Consequently, said paste substance, coming from the hopper 2 and about to fill the inlet channel 12, is urged to enter the cylinder 11, filling both the volume created in the latter by the descent of the piston 20 and the one defined by the groove 21.

It is noted in particular, how the dimension of the inlet channel 12, its course without obstacles and the rounded profile of said groove 21 allow a complete filling even with paste substances with high viscosity.

When the above suction step is completed, the piston 20 is rotated to the position K2, thus closing the inlet aperture 13 and opening the outlet aperture 14.

This way, the delivery step is begun, in which the piston 20 is made go up along a fraction proportional to the volume of paste substance, which must be expelled through the exhaust conduit 40, so as to be sent to the filling nozzle, which will introduce it into the container.

Obviously, it is necessary that at the beginning of the delivery step, the whole path downstream of the outlet aperture 14 be already full of paste substance, so that the metered quantity is actually introduced into the container.

It is noted also in this case, how the dimension of the exhaust conduit 40 and the course of the channel defined by the conveying means 60 downstream of the latter allow an easy and regular flow of the paste substance, which avoids arising of counter-pressures, slowing down the delivery step and consequently the speed of filling the container.

The above described shape of the device 1 has been carefully examined not only for ensuring an optimal operation, but also for facilitating and speeding up cleaning of the device 1, its sanitation and/or sterilization operations, when the substance is changed, or at scheduled intervals, if the same substance remains, so as to avoid the accumulation of residues which could deteriorate and damage another, fresh substance, getting in touch with the old one.

Actually, due to the quick coupling means 51, 52, 53, which advantageously can be handled without tools, the device 1 can be removed quickly from the machine and disassembled to be subjected to cleaning, sanitation and/or sterilization operations, and when these operations are completed, it can be reassembled and mounted onto the machine, likewise quickly.

As it has already been said in the introductory note, it is obvious how important it is to reduce the machine downtimes, since the machine usually includes a large number of devices 1 arranged in battery.

The machine downtimes can be reduced also due to an accurate analysis of the shape of different elements of the device 1, regular, simple and possibly devoid of interstices, recesses, grooves or the like, so that they can be cleaned, sanitized and/or sterilized quickly and efficiently.

The machine downtimes can be reduced also due to an accurate analysis of the shape of different elements of the device 1, regular, simple and possibly devoid of interstices, recesses, grooves or the like, so that they can be cleaned, sanitized and/or sterilized quickly and efficiently. The inlet channel 12 made in the central body 10, the position of the inlet conduit block 30 above and touching the upper part of the same central body 10, allows to reduce considerably the dimensions of the proposed device.

Moreover, the latter is particularly compact, which positively influences its strength and consequently, its life.

Consequently, although the above described device re-proposes the operation principles of the known valve-syringes for liquids, it presents innovative constructive aspects, which make it suitable for paste substances of low and high viscosity, thus allowing to obtain all the advantages of the machine construction and of the fastening to and removing from the latter, as it has already been discussed in the introductory note with reference to the valve-syringes for liquids.

I claim:

1. A device for delivering metered quantities of a paste substance to containers, the delivering device being associated to an automatic machine including:

a hopper for supplying said paste substance to the delivering device;

at least one filling nozzle, connected to the delivering device;

said delivering device including: a central body;

a vertical cylinder made in said central body, with an open upper end and two lateral diametrically opposite and horizontally aligned apertures, respectively an inlet aperture and an outlet aperture;

a cap for closing the upper end of said cylinder;

an inlet channel situated beside the cylinder and parallel to the cylinder, the inlet channel having an open upper end and a lower end leading to the inlet aperture of said cylinder;

a piston sliding to move up and down inside said cylinder between an upper dead position and a lower dead position;

a longitudinal groove extending from a top of the piston downwards, along a part of the piston, such that a bottom end of said groove is aligned with lower ends of said inlet aperture and outlet aperture, when the piston is in the upper dead position;

an inlet conduit block fastened removably to said central body to connect a lower outlet aperture of said hopper with said inlet channel;

an exhaust conduit connecting said outlet aperture with conveying moans leading to said filling nozzle;

a stem made integral with said piston and removably connected to power means provided for operating the piston to move up and down and into rotation in step relation with an up and down motion, so that when the piston goes down, said longitudinal groove faces said inlet aperture, for performing a suction step and introducing said paste substance, coming from the hopper, into said cylinder, whereas when the piston is moved upwards said longitudinal groove faces said outlet aperture, for performing a delivery step and delivering a metered quantity of said paste substance expelled from the cylinder to said filling nozzle.

2. A device, according to claim 1, wherein the piston extends axially with a dimension longer than a distance between said cap and the lower ends of said inlet aperture and outlet aperture.

3. A device, according to claim 1, wherein said longitudinal groove of the piston, as seen from top, has a rounded profile and a section at least equal to a section of the inlet channel.

4. A device, according to claim 1, wherein said inlet conduit block is shaped in such a way that said lower outlet aperture is almost coaxial with a bore of the cylinder, thus defining a non-straight path.

5. A device, according to claim 1, wherein said inlet conduit block (30) is shaped in such a way that said lower outlet aperture is coaxial with the inlet channel, thus defining a straight channel.

6. A device, according to claim 1, wherein said inlet conduit block, when fastened to central body, pushes on top of the cap.

7. A device, according to claim 6, wherein said cap is removable.

8. A device, according to claim 1, further including quick coupling means for removably fastening said central body to the inlet conduit block.

9. A device, according to claim 1, further including quick coupling means for removably fastening said inlet conduit block to the hopper.

10. A device, according to claim 1, further including quick coupling means for removably fastening said exhaust conduit to the conveying means connected to the filling nozzle.

11. A device, according to claim 1, further including quick coupling means for removably fastening said stem to the power means.

12. A device, according to claim 1, further including:

first quick coupling means for removably fastening said central body to the inlet conduit block;

second quick coupling means for removably fastening said inlet conduit block to the hopper;

third quick coupling means for removably fastening said exhaust conduit to the conveying means connected to the filling nozzle; and fourth quick coupling means for removably fastening said stem to the power means.

* * * * *